US009221633B2

(12) United States Patent
Lee et al.

(10) Patent No.: US 9,221,633 B2
(45) Date of Patent: Dec. 29, 2015

(54) PRINTING MEDIUM SUPPLY DEVICE AND IMAGE FORMING APPARATUS HAVING THE SAME

(71) Applicant: Samsung Electronics Co., Ltd., Suwon-si (KR)

(72) Inventors: Jae Wuk Lee, Suwon-si (KR); Je Won Jeong, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/490,038

(22) Filed: Sep. 18, 2014

(65) Prior Publication Data

US 2015/0084268 A1 Mar. 26, 2015

(30) Foreign Application Priority Data

Sep. 26, 2013 (KR) ..... 10-2013-0114609

(51) Int. Cl.

| | |
|---|---|
| ***B65H 3/06*** | (2006.01) |
| ***B65H 1/12*** | (2006.01) |
| ***B65H 5/06*** | (2006.01) |
| ***B65H 1/04*** | (2006.01) |

(52) U.S. Cl.

CPC ..... *B65H 3/0684* (2013.01); *B65H 1/04* (2013.01); *B65H 1/12* (2013.01); *B65H 5/068* (2013.01)

(58) Field of Classification Search

CPC ..... B65H 3/06; B65H 3/03684; B65H 2404/152; B65H 2404/1521

USPC ..... 271/117, 118

See application file for complete search history.

(56) References Cited

U.S. PATENT DOCUMENTS

| | | | | |
|---|---|---|---|---|
| 5,893,555 | A * | 4/1999 | Kawada et al. | 271/117 |
| 7,156,389 | B2 * | 1/2007 | Kadowaki et al. | 271/118 |
| 2009/0014940 | A1 | 1/2009 | Lim | |
| 2011/0121509 | A1 * | 5/2011 | Shin et al. | 271/117 |
| 2012/0074636 | A1 | 3/2012 | Choi | |
| 2012/0126475 | A1 | 5/2012 | Shin et al. | |

FOREIGN PATENT DOCUMENTS

JP 2008-297097 12/2008

OTHER PUBLICATIONS

International Search Report dated Jan. 2, 2015 in International Patent Application No. PCT/KR2014/009029.

* cited by examiner

*Primary Examiner* — Michael McCullough
(74) *Attorney, Agent, or Firm* — Staas & Halsey LLP

(57) ABSTRACT

A printing medium supply device and an image forming apparatus having the same are provided. The printing medium supply device may include a pickup unit and an adjustment unit. The pickup unit may include a shaft, a pickup roller spaced apart from the shaft to come into contact with printing media, a pickup holder to support the pickup roller, the pickup holder being rotated about the shaft to lift or lower the pickup roller, and a link member connected to the pickup holder so as to be rotated about the shaft. The adjustment unit may include a pressure member coming into contact with a pressure applied portion of the link member to rotate the link member by applying pressure thereto, and an elastic member elastically supported by the pressure member to transmit elastic force to the link member. This configuration ensures constant pickup pressure despite variation in the quantity of printing media.

29 Claims, 10 Drawing Sheets

PRINTING MEDIUM SUPPLY DEVICE AND IMAGE FORMING APPARATUS HAVING THE SAME

CROSS-REFERENCE TO RELATED APPLICATIONS

This application claims the priority benefit of Korean Patent Application No. 10-2013-0114609, filed on Sep. 26, 2013 in the Korean Intellectual Property Office, the disclosure of which is incorporated herein by reference.

BACKGROUND

1. Field

Embodiments relate to a printing medium supply device having an improved configuration to enhance pickup performance and an image forming apparatus having the same.

2. Description of the Related Art

Image forming apparatuses are devised to form an image on a printing medium based on an input signal. Examples of image forming apparatuses include printers, copiers, fax machines, and devices combining functions thereof.

Image forming apparatuses include a printing medium supply device for supply of a printing medium. Typically, the printing medium supply device picks up loaded printing media one by one to supply the same into a main body of the image forming apparatus.

More specifically, one or more sheets of printing media are loaded in the printing medium supply device and are picked up one by one by a pickup roller to be supplied into the main body of the image forming apparatus through a feed roller.

However, pickup pressure applied to printing media by the pickup roller varies based on the quantity of loaded printing media, which may problematically cause supply of plural sheets of printing media at once or no supply of printing media.

SUMMARY

In an aspect of one or more embodiments, there is provided a printing medium supply device having an improved configuration to enhance pickup performance of a pickup roller, and an image forming apparatus having the same.

In an aspect of one or more embodiments, there is provided a printing medium supply device which may be reduced in size to reduce the size of the entire image forming apparatus or may enhance utility of an inner space of the image forming apparatus, and an image forming apparatus having the same.

In an aspect of one or more embodiments, there is provided a printing medium supply device which includes a pickup unit to pick up a printing medium one by one, the pickup unit including a shaft, a pickup roller spaced apart from the shaft to come into contact with a printing medium, a pickup holder configured to support the pickup roller, the pickup holder being rotated about a shaft to lift or lower the pickup roller, and a link member connected to the pickup holder so as to be rotated about the shaft, and an adjustment unit including a pressure member coming into contact with a pressure applied portion of the link member to rotate the link member by applying pressure to the link member, and an elastic member elastically supported by the pressure member to transmit elastic force to the link member.

The printing medium supply device may further include a tray on which printing media is loaded, and the pickup roller may have a variable vertical position depending on the quantity of printing media loaded on the tray, and a distance from the center of the shaft to the pressure applied portion may vary based on a position of the pickup roller.

The distance may be r1 when the pickup roller is located at a first position and the distance may be r2 when the pickup roller is located at a second position lower than the first position. The distance r2 may be greater than the distance r1.

The link member may be pivotally rotated along with the pickup holder.

The pickup holder may include a holder body configured to be pivotally rotated about the shaft, a holder rotating portion coupled to the shaft at one side of the holder body, and a holder support portion configured to support the pickup roller at the other side of the holder body.

The pressure member may include a movable pressure member body, an elastic hook formed at the movable pressure member body so that one end of the elastic member is fixed to the elastic hook, and a pressure applying portion formed at one end of the movable pressure member body to apply pressure to the link member.

The pressure member may further include a pressure member rotating portion formed at the other end of the movable pressure member body to enable pivotal rotation of the movable pressure member body.

The pressure member rotating portion may be rotated about a pressure member rotating axis spaced apart from the shaft.

One end of the elastic member may be fixed to the elastic hook formed at the pressure member, and the other end of the elastic member may be fixed to an elastic fixing portion formed at a printing medium supply device case defining an external appearance of the printing medium supply device.

The pressure applied portion of the link member may be moved to be spaced apart from the shaft as the pickup roller is lowered.

The printing medium supply device may further include a supply tray on which printing media is loaded, and the pressure applied portion may be located within a pressure applied section defined between a first point on the link member and a second point on the link member, the first point on the link member coming into contact with a pressure applying portion of the pressure member when the pickup roller is spaced apart from the supply tray, and the second point on the link member coming into contact with the pressure applying portion when the pickup roller comes into close contact with the supply tray, the second point on the link member being farther spaced apart from the shaft than the first point on the linked member.

Moment of the pickup holder about the shaft, generated by a distance between the pressure applied portion and the shaft and elastic force of the elastic member, may keep a constant magnitude.

The pickup unit may further include a plurality of gears to transmit rotation of the shaft to the pickup roller, and one-way clutches arranged respectively at a junction between the shaft and the feed roller and the pickup roller and a junction between the pickup roller and the gears.

In an aspect of one or more embodiments, there is provided an image forming apparatus which includes an image forming apparatus main body, and a printing medium supply device to supply a printing medium into the image forming apparatus main body, wherein the printing medium supply device includes a printing medium supply device case, a shaft rotated by a drive source and pivotally rotatably supported by the printing medium supply device case, a pickup roller spaced apart from the shaft so as to come into contact with the printing medium, a pickup holder configured to support the pickup roller, the pickup holder being rotated about the shaft to lift or lower the pickup roller, a link member configured to be pivotally rotated along with the pickup holder, a pressure member having a pressure applying portion formed at one end thereof to apply pressure to the link member, and an elastic member to generate elastic force for pickup pressure of the pickup roller to be applied to the printing medium, one end of the elastic member being fixed to the pressure member, wherein a distance between a pressure applied portion, located on the link member to correspond to the pressure applying portion of the pressure member, and a center of the shaft varies based on a position of the link member.

The printing medium supply device may further include a tray on which printing media is loaded, the pickup roller may have a variable vertical position depending on the quantity of printing media loaded on the tray, and the distance from the center of the shaft to the pressure applied portion may vary based on a position of the pickup roller.

The distance may be r1 when the pickup roller is located at a first position and the distance may be r2 when the pickup roller is located at a second position lower than the first position. The distance r2 may be greater than the distance r1.

The pickup roller may have a variable vertical position depending on the quantity of printing media loaded on the tray, and elastic force of the elastic member may vary based on a position of the pickup roller.

The elastic force may be F1 when the pickup roller is located at a first position and the elastic force may be F2 when the pickup roller is located at a second position lower than the first position. The elastic force F2 may be less than the elastic force F1.

The pickup holder may include a holder body configured to be pivotally rotated about the shaft, a holder rotating portion coupled to the shaft at one side of the holder body, and a holder support portion configured to support the pickup roller at the other side of the holder body.

The holder body and the link member may be perpendicular to each other.

The pickup holder and the link member may be integrally formed with each other.

The pressure member may include a pressure member rotating portion to enable pivotal rotation of the pressure applying portion of the pressure member, the pressure member rotating portion having a pressure member rotating axis spaced apart from the shaft.

A position of the pressure applied portion on the link member may be variable as the pickup roller is lifted or lowered.

The other end of the elastic member may be fixed to an elastic fixing portion formed at the printing medium supply device case so that a length of the elastic member is variable via movement of the pressure applying portion of the pressure member.

In an aspect of one or more embodiments, there is provided a printing medium supply device includes a pickup unit to pick up a printing medium one by one, the pickup unit including a shaft, a pickup roller spaced apart from the shaft to come into contact with a printing medium, a pickup holder configured to support the pickup roller, the pickup holder being rotated about the shaft to lift or lower the pickup roller, and a link member connected to the pickup holder to adjust pressure to be applied to the pickup roller, and an adjustment unit to allow the pickup roller to apply constant pickup pressure to the printing medium, the adjustment unit including an elastic member to provide the pickup roller with pickup force for the printing medium and a pressure member connected to one end of the elastic member to apply pressure to the link member.

In an aspect of one or more embodiments, there is provided a printing medium supply device including a pickup roller spaced apart from a shaft and configured to come into contact with a printing medium; a pickup holder configured to support the pickup roller, the pickup holder being pivotally rotated along with the shaft to lift or lower the pickup roller; a link member provided at the pickup holder to adjust pressure to be applied to the pickup roller; an elastic member to provide the pickup roller with pickup force for the printing medium; and a pressure member connected to one end of the elastic member to apply pressure to the link member.

In an aspect of one or more embodiments, there is provided a printing medium supply device including a pickup holder, one side of which is rotatable about a first axis; a pickup roller supported by the other side of the pickup holder so as to be vertically moved via rotation of the pickup holder, the pickup roller being rotatable about a second axis to come into contact with a printing medium and pick up the printing medium; a pressure member to apply pressure to the pickup holder, the pressure member being rotatable about a third axis; and an elastic member to elastically bias the pressure member so that the pressure member rotates the pickup holder to push the pickup roller toward the printing medium.

In an aspect of one or more embodiments, there is provided a printing medium supply device including a pickup roller configured to come into contact with a printing medium; a pickup holder configured to support the pickup roller, the pickup holder being rotated about a shaft to lift or lower the pickup roller; a link member connected to the pickup holder so as to be rotated about the shaft; a pressure member including a pressure member body, a pressure applying portion provided at an end of the pressure member body and coming into contact with a pressure applied portion of the link member to rotate the link member by applying pressure to the pressure applied portion of the link member, a sliding member to slide the pressure member body, and an elastic hook; and an elastic member elastically supported by the pressure member to transmit elastic force to the link member, wherein the elastic hook is formed on the pressure member body to fix one end of the elastic member.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
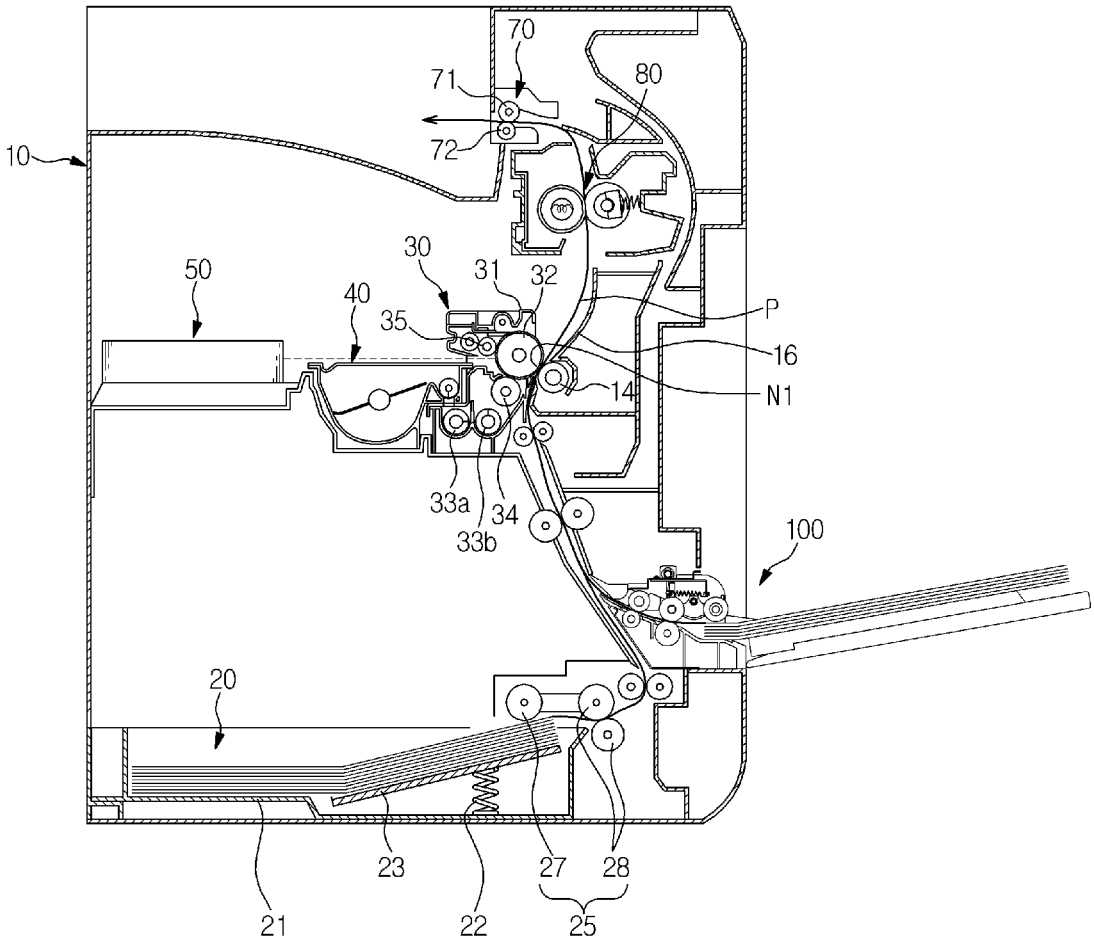
FIG. 1 is a sectional view of an image forming apparatus in accordance with one embodiment.

Reference will now be made in detail to embodiment, examples of which are illustrated in the accompanying drawings, wherein like reference numerals refer to like elements throughout.

FIG. 1 is a sectional view of an image forming apparatus in accordance with one embodiment As exemplarily shown in FIG. 1, the image forming apparatus 1 includes a main body 10, a printing medium supply device (printing medium supplier) 20; a printing medium supply device (printing medium supplier) 100 for storage and for supplying of printing media S, a developing device (developer) 30 to form an image on each printing medium S supplied via the printing medium supply device 20; a toner device 40 to feed toner to the developing device 30, a light scanning device (light scanner) 50 to form an electrostatic latent image on a photoconductor 32, a fixing device 80 to fix a toner image transferred onto the printing medium S to the printing medium S, and a printing medium discharge device 70 to discharge the printing medium S on which the image has been completely formed to the outside of the main body 10.

The printing medium supply device 20 serves to store and supply the printing media S, and is located below the main body 10 to supply the printing media S to the developing device 30.

The printing medium supply device 20 may include a printing medium cassette 21 configured to be withdrawn from the main body 10 for storage of the printing media S, and a delivery member 25 to pick up the printing media S stored in the printing medium cassette 21 one by one and deliver the same to the developing device 30.

To guide the loaded printing media S to the delivery member 25, a knock-up plate 23 may be installed in the printing medium cassette 21 such that one end thereof is rotatably coupled to the printing medium cassette 21 and the other end thereof is supported by a pressure spring 22.

The delivery member 25 may include a pickup roller 27 to pick up the printing media S loaded on the knock-up plate 23 one by one, and a feed roller 28 to deliver each printing medium S picked up by the pickup roller 27 to the developing device 30.

The developing device 30 includes a housing 31 defining an external appearance of the developing device 30, the photoconductor 32 rotatably installed in the housing 31 such that an electrostatic latent image is formed thereon, agitator screws 33*a*, 33*b* to agitate toner fed into the toner device 40, a developing roller 34 to feed the toner agitated by the agitator screws 33*a*, 33*b* to the photoconductor 32, and a charge member 35 to charge the photoconductor 32.

The toner fed from the toner device 40 is introduced into the housing 31 and is agitated and delivered to one side of the housing 31 by the agitator screws 33*a*, 33*b*. The delivered toner is fed to the photoconductor 32 by the developing roller 34 to form a visible toner image.

To transfer the visible toner image formed on the photoconductor 32 to the printing medium S, the photoconductor 32 comes into contact with the transfer roller 14 to define a transfer nip N1 with a transfer roller 14. The transfer roller 14 is rotatably placed within the main body 10.

The toner device 40 is coupled to the developing device 30 and serves to receive and store toner used to form an image on the printing medium S. The toner device 40 feeds toner to the developing device 30 during an image forming operation.

The light scanning device 50 emits light including image information to the photoconductor 32 to form an electrostatic latent image on the photoconductor 32.

The fixing device 80 fixes the toner image, formed on the printing medium S, to the printing medium S by applying heat and pressure to the printing medium S. A detailed description related to a configuration of the fixing device 80 will follow later.

The printing medium discharge device 70 includes a first discharge roller 71 and a second discharge roller 72 which are sequentially arranged to discharge the printing medium S having passed through the fixing device 80 to the outside of the main body 10.

A guide rib 16 is disposed between the transfer nip N1 and the fixing device 80 and serves to guide the printing medium S having passed through the transfer nip N1 to the fixing device 80. The guide rib 16 defines a portion of a delivery path P of the printing medium S between the transfer nip N1 and the fixing device 80.

Figure 2:
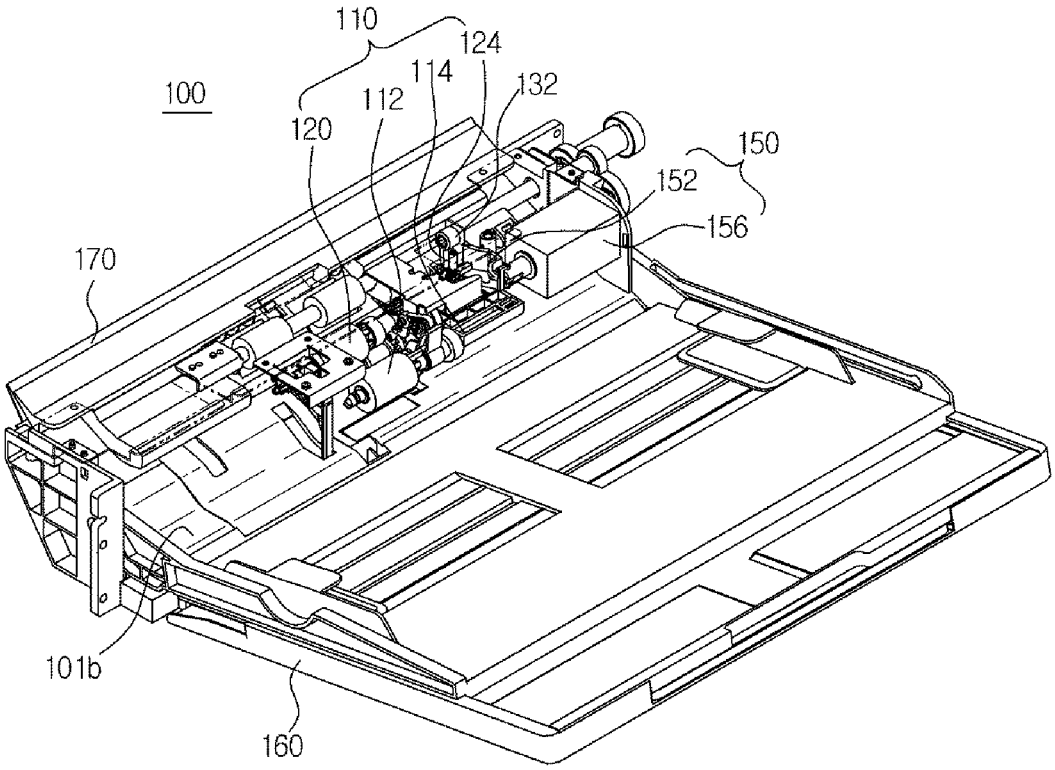
FIG. 2 is a perspective view of a printing medium supply device in accordance with one embodiment.
Figure 3:
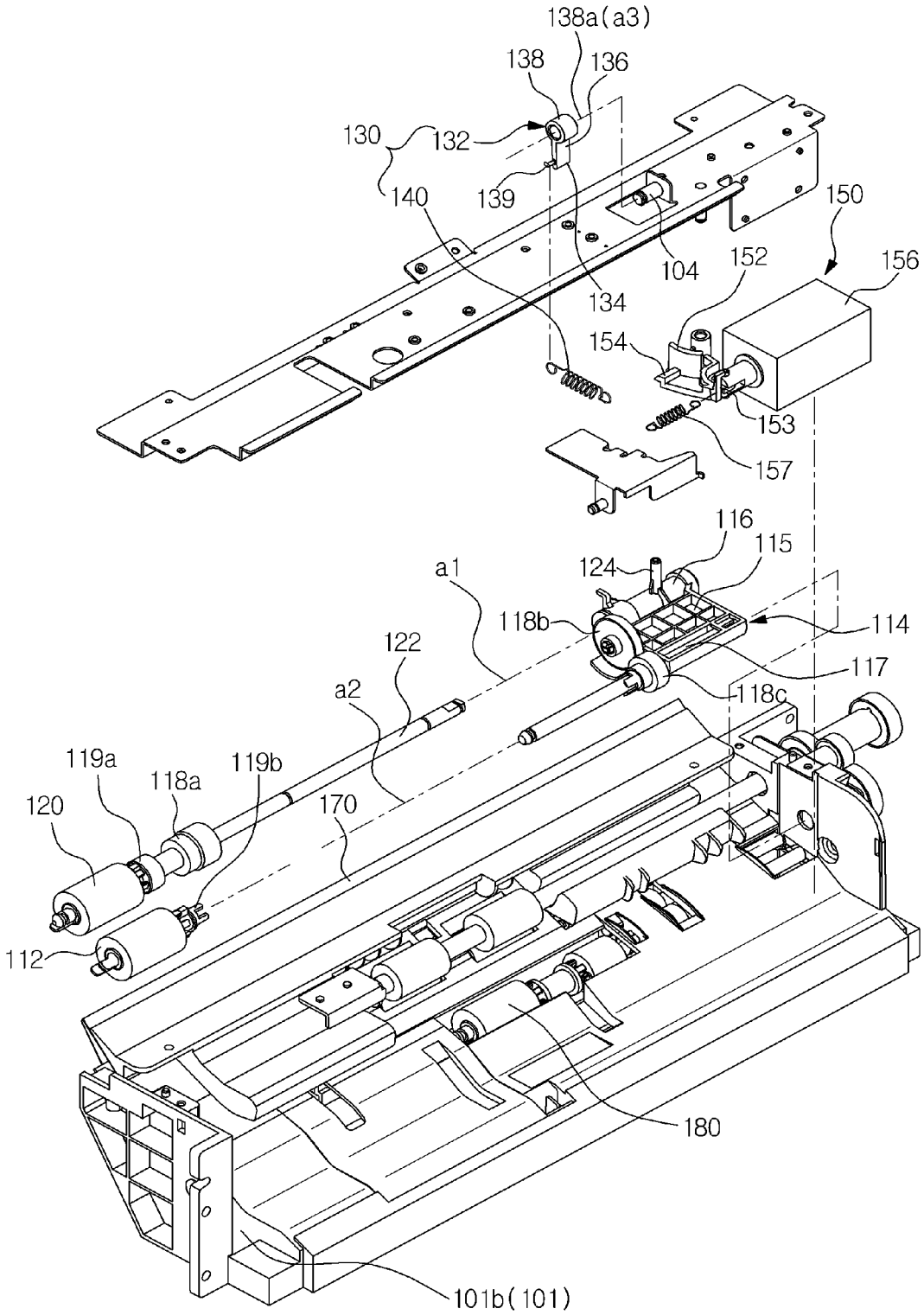
FIG. 3 is an exploded perspective view of the printing medium supply device in accordance with one embodiment.
Figure 4:
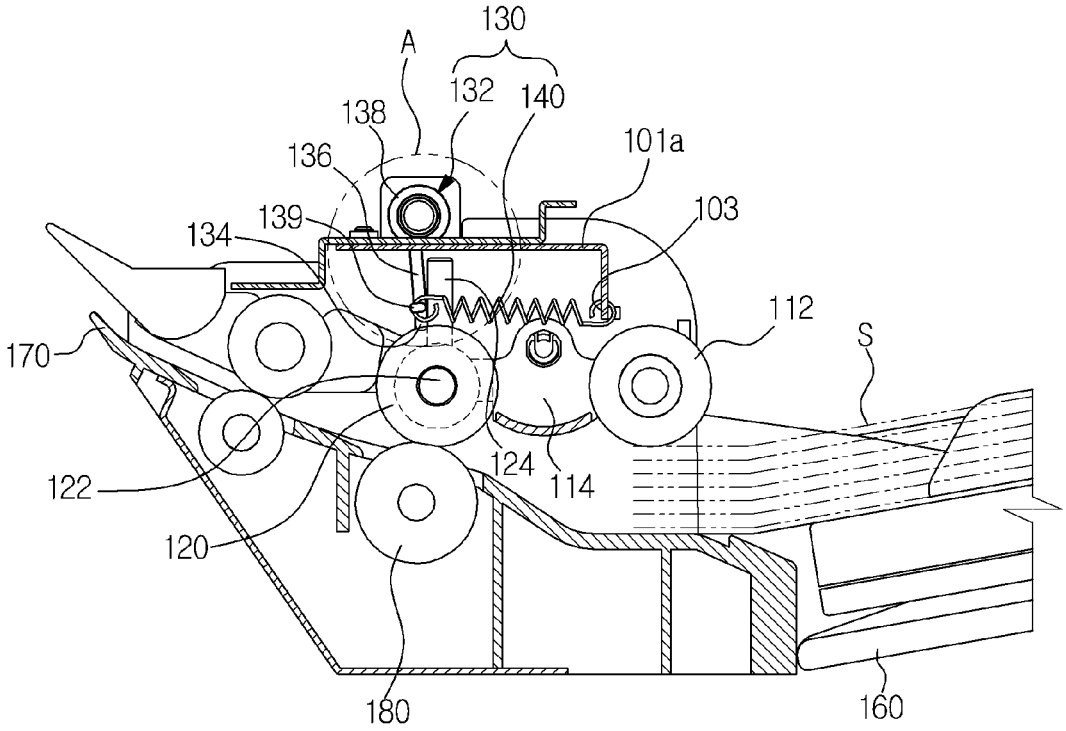
FIG. 4 is a sectional view showing operation of a pickup roller in the printing medium supply device in accordance with one embodiment.
Figure 5:
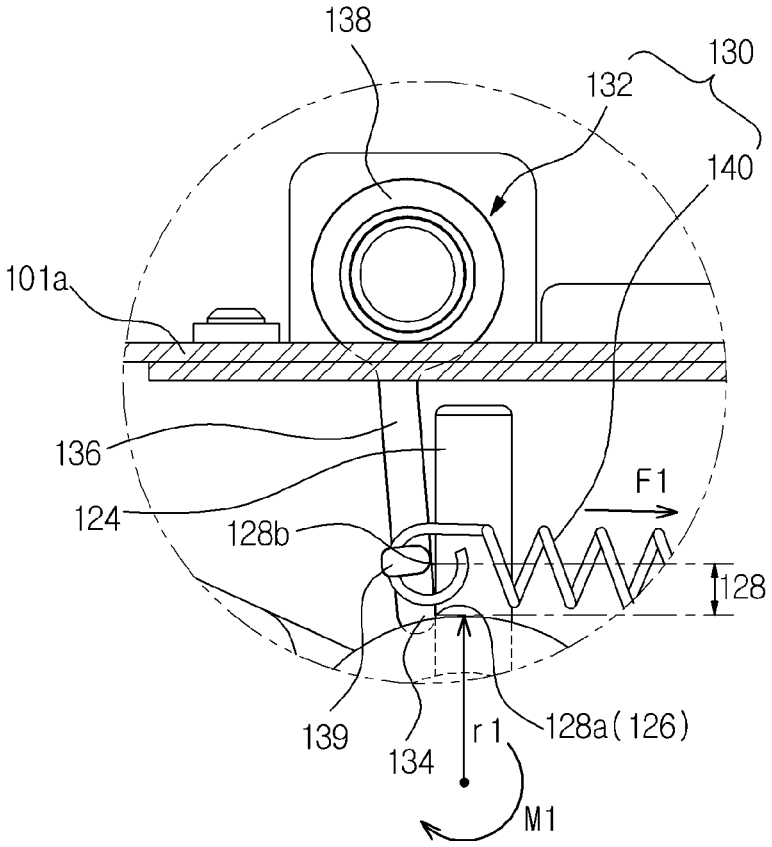
FIG. 5 is an enlarged view of portion A of FIG. 4.
Figure 6:
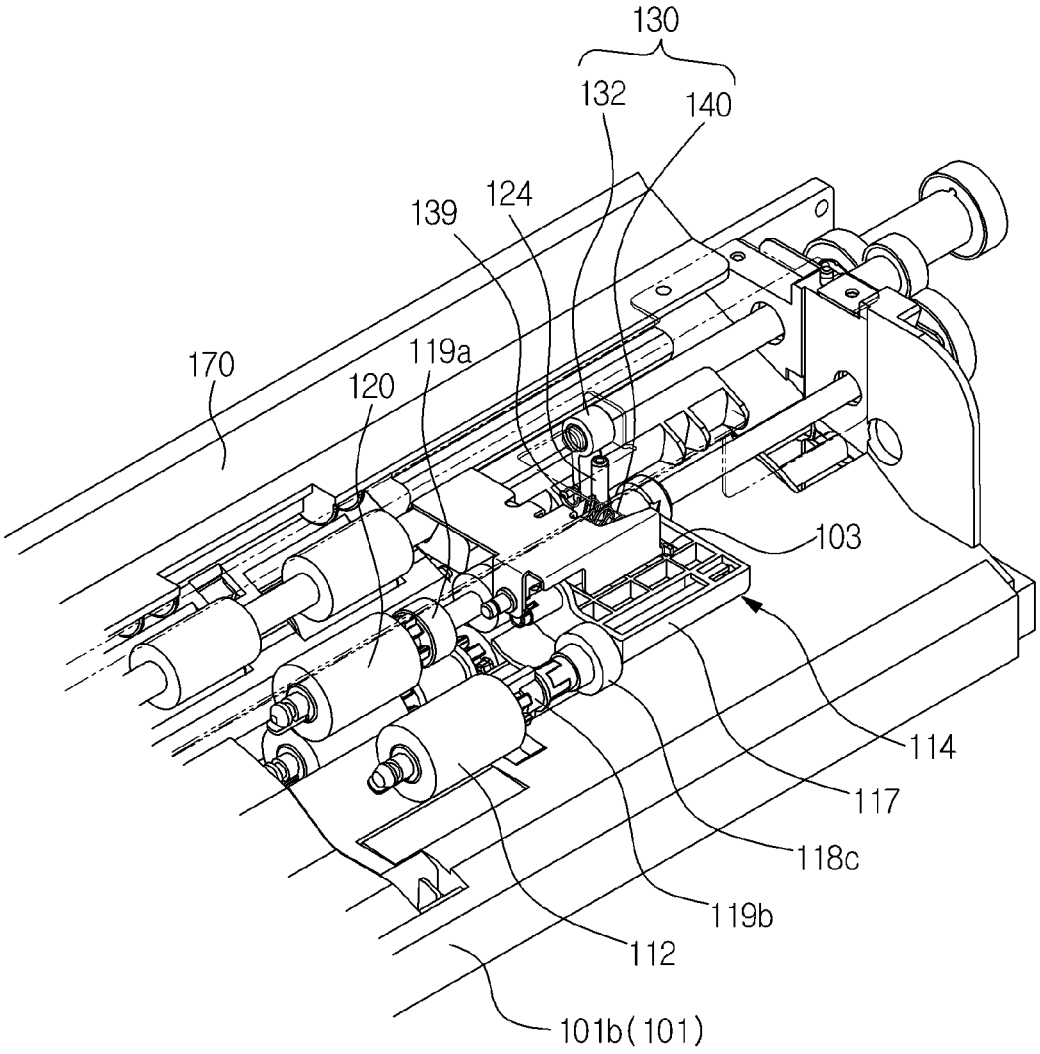
FIG. 6 is a perspective view showing operation of the pickup roller in the printing medium supply device in accordance with one embodiment.
Figure 7:
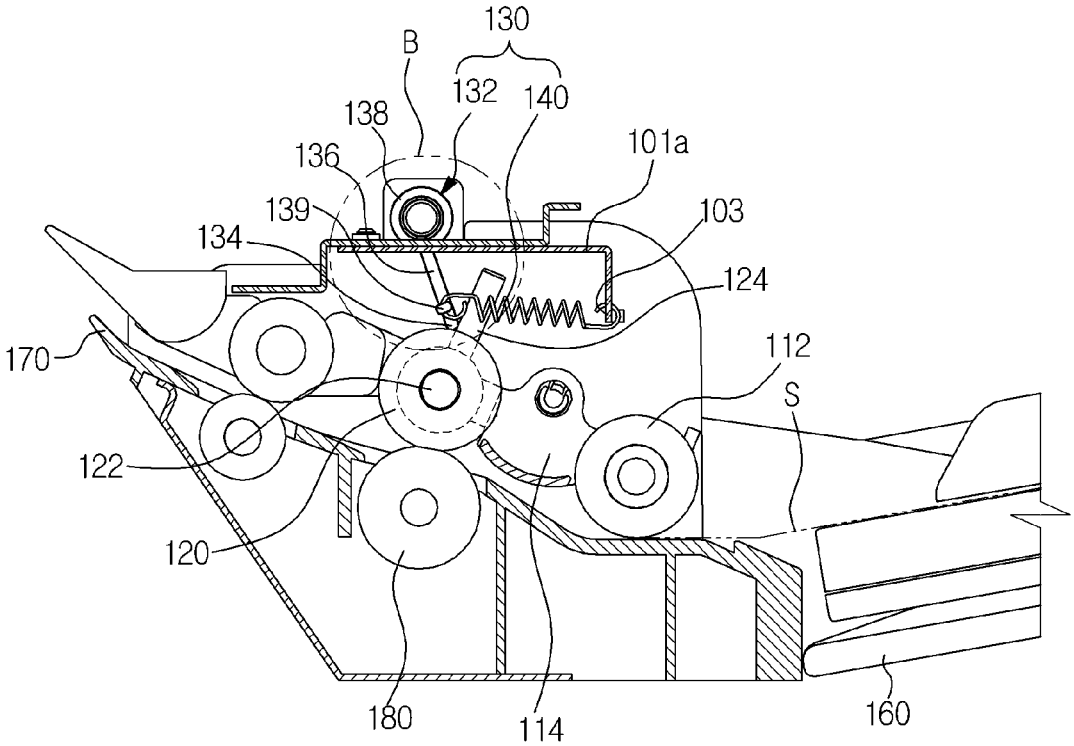
FIG. 7 is a sectional view showing operation of the pickup roller in the printing medium supply device in accordance with one embodiment.
Figure 8:
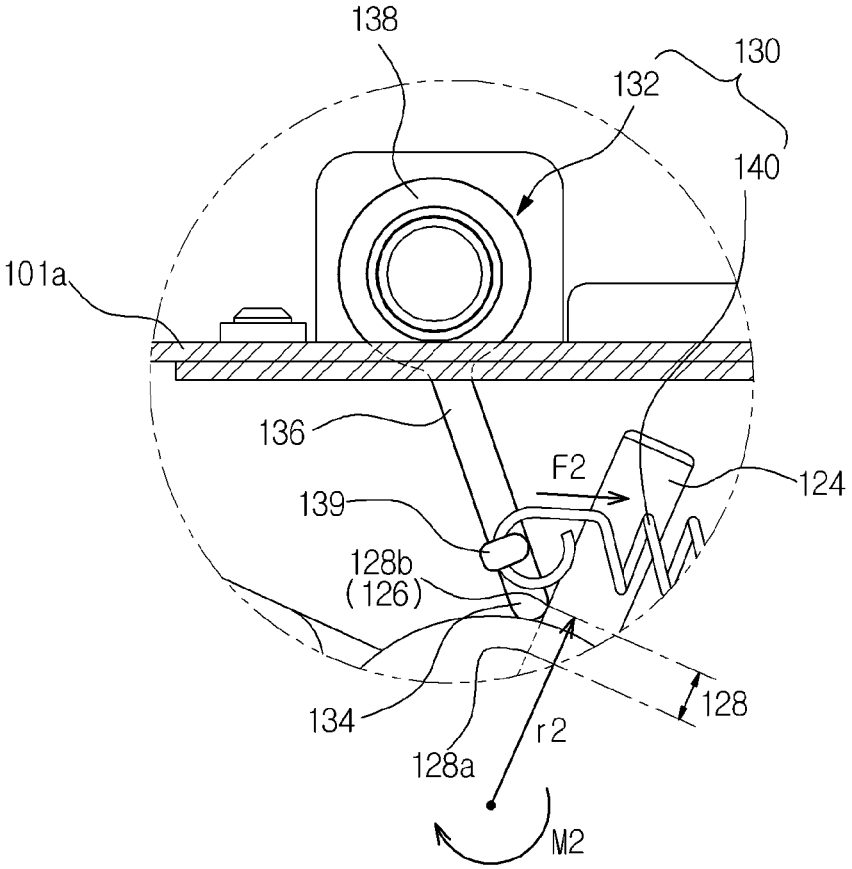
FIG. 8 is an enlarged view of portion B of FIG. 7.
Figure 9:
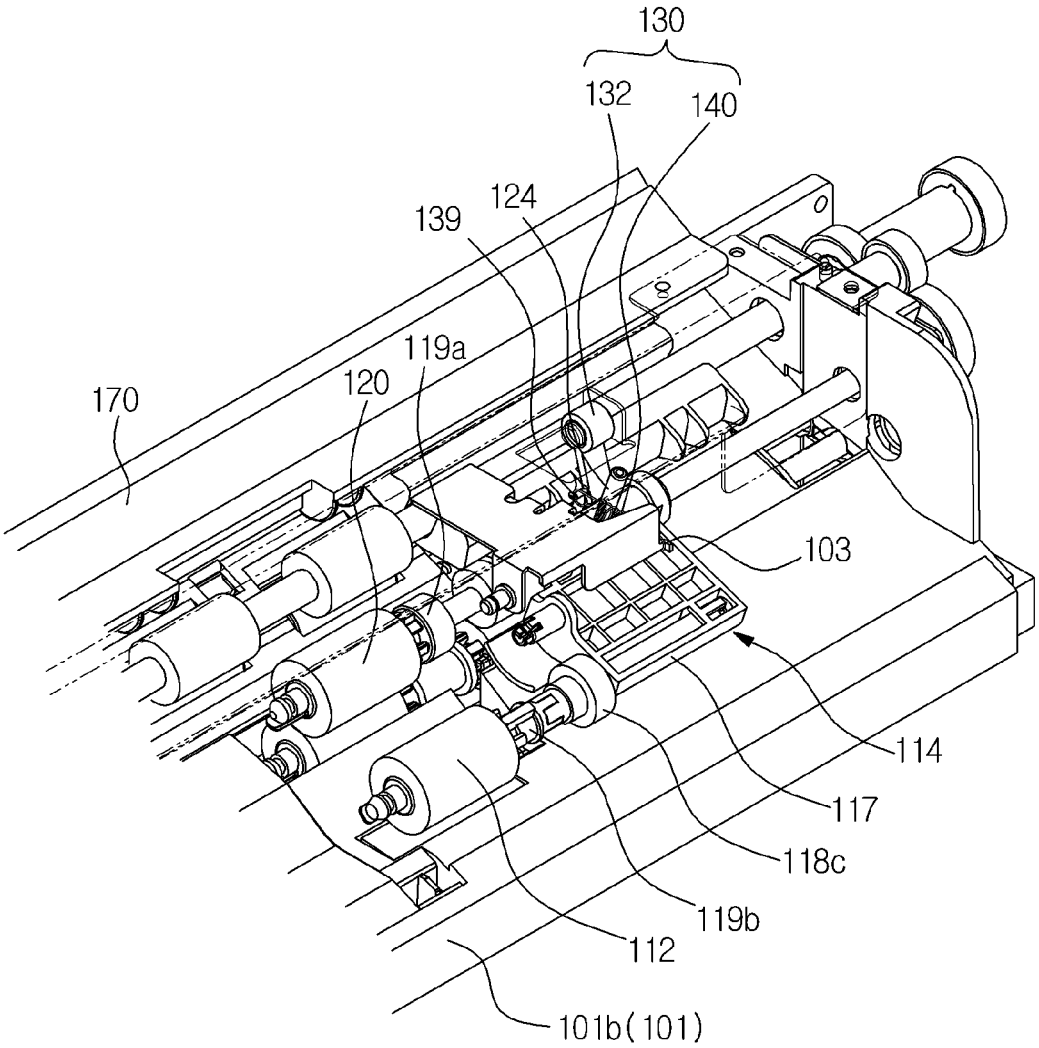
FIG. 9 is a perspective view showing operation of the pickup roller in the printing medium supply device in accordance with an embodiment.
Figure 10:
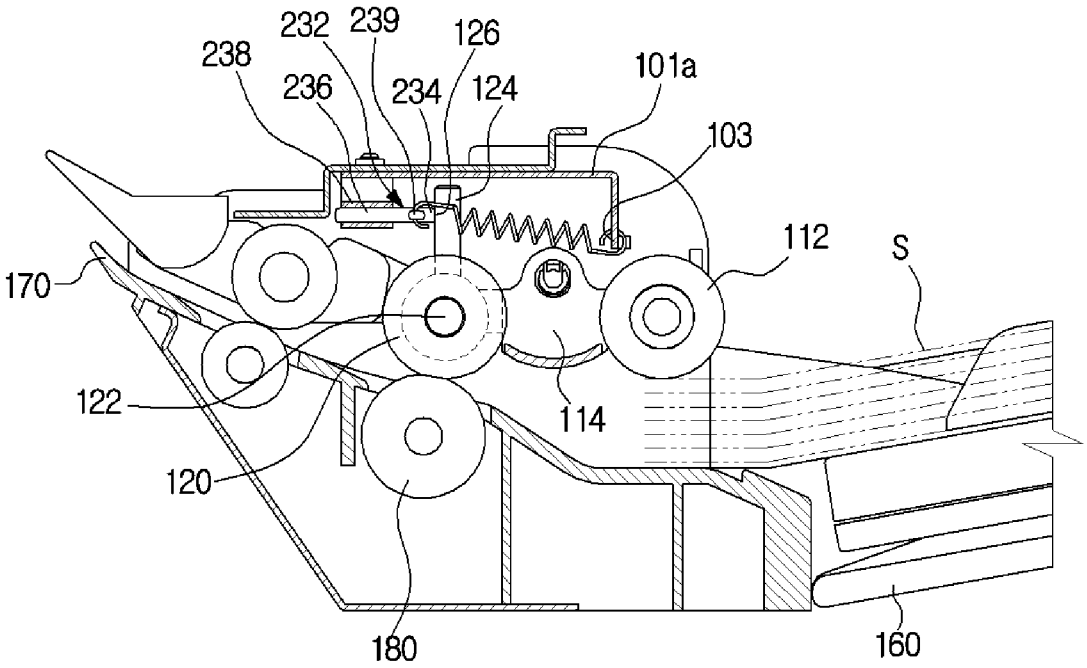
FIG. 10 is a sectional view of a printing medium supply device in accordance with an embodiment.

FIG. 2 is a perspective view of the printing medium supply device in accordance with an embodiment, FIG. 3 is an exploded perspective view of the printing medium supply device in accordance with an embodiment, FIG. 4 is a sectional view showing operation of the pickup roller in the printing medium supply device in accordance with an embodiment, FIG. 5 is an enlarged view of portion A of FIG. 4, FIG. 6 is a perspective view showing operation of the pickup roller in the printing medium supply device in accordance with embodiment, FIG. 7 is a sectional view showing operation of the pickup roller in the printing medium supply device in accordance with an embodiment, and FIG. 8 is an enlarged view of portion B of FIG. 7. FIG. 9 is a perspective view showing operation of the pickup roller in the printing medium supply device in accordance with an embodiment, and FIG. 10 is a sectional view of a printing medium supply device in accordance with an embodiment.

The above described printing medium supply device 20 has been described above as including the printing medium cassette 21, and the printing medium supply device 100 that will be described below includes a supply tray 160. However, it will be appreciated that the printing medium supply device 100 that will be described below may be applied to not only a configuration including the supply tray 160, but also a configuration including the printing medium cassette 21.

The printing medium supply device 100 serves to store and supply the printing media S, and is installed below or next to the main body 10 to supply the printing media S to the developing device 30.

The printing medium supply device 100 may include a printing medium supply device case 101, a pickup unit 110, an adjustment unit 130, and the supply tray 160.

The printing medium supply device case 101 serves to protect inner components, and includes an upper case 101*a* and a lower case 101*b*.

The printing media S to be supplied into the image forming apparatus 1 is loaded on the supply tray 160. The supply tray 160 may be received in the image forming apparatus 1, but may protrude outward from the image forming apparatus 1 as shown in the drawing. The supply tray 160 has a pivotally rotatable one end. Thus, the supply tray 160 is pivotally rotated to close the main body 10 to constitute a portion of the main body 10 when not in use, and is pivotally rotated to open the main body 10 to allow the printing media S to be loaded on the supply tray 160 when in use. Rather than being limited to the above described configuration, the supply tray 160 may be separably provided so as to be coupled to the main body 10 as needed.

The supply tray 160 may include a manual supply tray. The printing medium cassette 21 is usually used to supply standard paper as the printing media S, whereas the manual supply tray is a multi-purpose tray that is usually used to supply special paper, such as, for example, narrow postcards and envelopes, standard or nonstandard thick letter paper and OHP sheets as the printing media S. Naturally, the supply tray 160 may implement supply of standard common paper.

The pickup unit 110 picks up the printing media S loaded on the supply tray 160 one by one.

The pickup unit 110 may include a pickup roller 112, a pickup holder 114, and a feed roller 120.

The pickup roller 112 may be positioned above a tip end of the printing medium S in a supply direction of the printing medium S loaded on the supply tray 160. Through rotation of the pickup roller 112, an uppermost printing medium S among the printing media S loaded on the supply tray 160 is picked up one by one.

The feed roller 120 is located at the rear of the pickup roller 112 and serves to deliver the printing medium S, picked up by the pickup roller 112, to a guide frame 170 and to supply the printing medium S into the image forming apparatus 1.

The feed roller 120 may be coupled to a shaft 122 that is rotatably coupled to a drive source (not shown). The shaft 122 may be pivotally rotatably supported by the printing medium supply device case 101. The supply roller 120 and the pickup roller 112 may be spaced apart from each other to prevent interference with rotation of the respective rollers 120, 112.

The feed roller 120 and the pickup roller 112 may be connected to each other via the pickup holder 114. The pickup holder 114 supports the pickup roller 112 and is rotatable about the shaft 122 to lift or lower the pickup roller 112.

Each of the feed roller 120 and the pickup roller 112 may be supported by the pickup holder 114.

The pickup holder 114 is rotated about the shaft 122 to lift or lower the pickup roller 112 based on the quantity of the printing media S on the supply tray 160. The shaft 122 may be rotatable about a first axis a1.

More specifically, the pickup holder 114 may include a holder body 115, a holder rotating portion 116 formed at one side of the holder body 115 and coupled to the shaft 122 so as to be rotated by the shaft 122, and a holder support portion 117 formed at the other side of the holder body 115 to support the pickup roller 112.

The pickup roller 112 is supported by the other side of the pickup holder 114 so as to be vertically moved via rotation of the pickup holder 114. The pickup roller 112 is rotatable about a second axis a2 to pick up the printing medium S coming into contact with the pickup roller 112.

A lower surface of the pickup holder 114 facing the printing medium S may be curved over at least a portion thereof for easy supply of the printing medium S.

The pickup unit 110 further includes a plurality of gears 118*a*, 118*b*, 118*c* to transmit torque, transmitted from the feed roller 120 through the shaft 122, to the pickup roller 112. The gears 118*a*, 118*b*, 118*c* include a driving gear 118*a* coupled to the feed roller 120, a driven gear 118*c* coupled to the pickup roller 112, and an intermediate gear 118*b* connecting the driving gear 118*a* and the driven gear 118*c* to each other. The intermediate gear 118*b* may be rotatably coupled to the pickup holder 114.

With the above described configuration, when the shaft 122 is rotated by a drive source (not shown), the pickup roller 122 is rotated along with the feed roller 120 to pick up the printing medium S on the supply tray 160. That is, as the printing medium S on the supply tray 160 comes into contact with the pickup roller 112, the printing medium S may be picked up one by one via rotation of the pickup roller 112, and delivered into the image forming apparatus 1 via rotation of the feed roller 120. The drive source (not shown) to rotate the shaft 122 for pickup operation may be a motor.

A first one-way clutch 119*a* is installed at a junction between the shaft 122 and the feed roller 120, and a second one-way clutch 119*b* is installed at a junction between the pickup roller 112 and the driven gear 118*c*. As such, even if the feed roller 120 and the pickup roller 112 are rotated as the printing medium S is discharged via operation of the feed roller 120 after completion of the pickup operation, these one-way clutches 119*a*, 119*b* may prevent this rotation from being transmitted to the shaft 122. That is, the first and second one-way clutches 119*a*, 119*b* allow torque of the shaft 122 to be transmitted to the feed roller 120 when the shaft 122 is rotated for pickup operation, and allow torque of the driven gear 118*c* rotated by operation of the feed roller 120 to be transmitted to the pickup roller 112. However, while the picked printing medium S is discharged, the feed roller 120 and the pickup roller 112 may be rotated regardless of rotation of the shaft 122. This serves to ensure smooth discharge of the printing medium S.

The pickup holder 114 may be provided with a link member 124.

The link member 124 may assist the adjustment unit 130 that will be described hereinafter in adjusting torque of the pickup holder 114. In addition, a locking unit 150 may apply pressure to the link member 124 to restrict rotation of the pickup holder 114 or release the restriction.

The link member 124 may take the form of a post orthogonal to the shaft 122. Although the link member 124 in accordance with an embodiment takes the form of a cylindrical post, the link member 124 may have a square post to increase a contact area and is not limited to any specific shape.

The link member 124 is provided at the pickup holder 114 so as to be fixed to the holder rotating portion 116 and is pivotally rotatable along with the pickup holder 114. Although the link member 124 and the pickup holder 114 are orthogonal to each other in an embodiment, an angle therebetween is not limited.

The adjustment unit 130 applies pressure to the link member 124 to adjust pickup pressure to be applied to the printing medium S by the pickup roller 112.

The adjustment unit 130 may include a pressure member 132 to apply pressure to the link member 124, and an elastic member 140 having one end elastically supported by the pressure member 132.

The pressure member 132 to apply pressure to the link member 124 may apply pressure a variable point of the link member 124 depending on a distance between the shaft 122 and a pressure region of the link member 124, thereby compensating for variation of elasticity depending on tension of the elastic member 140.

In other words, when pickup pressure of the pickup holder 114 is affected only by elastic force F of the elastic member 140, moment of the pickup roller 112 about the shaft 122 varies based on a vertical position of the pickup roller 112, which results in variation of pickup pressure applied to the printing medium S based on the quantity of the printing media S. Hence, through the above described configuration of an embodiment, moment may be kept constant by varying a distance r between the center of the shaft 122 and an elastic force application point, which may result in constant pickup pressure despite vibration in the quantity of the printing media S.

The pressure member 132 may include a pressure member body 136, a pressure member rotating portion 138, a pressure applying portion 134, and an elastic hook 139.

The pressure member body 136 may take the form of a post corresponding to the link member 124. Although an embodiment illustrates a square post shaped of the pressure member body 136 to facilitate application of pressure to the link member 124, the shape of the pressure member body 136 is not limited thereto.

The pressure member rotating portion 138 may be formed at one end of the pressure member body 136 to enable pivotal rotation of the pressure member body 136. The pressure member rotating portion 138 may be pivotally rotatably coupled to the upper case 101*a* of the printing medium supply device 100. More specifically, the upper case 101*a*, defining an upper portion of the printing medium supply device case 101, may function to protect inner components, and may include a pivotal rotation support rod 104 to support the pressure member rotating portion 138 in a pivotally rotatable manner. The pressure member 132 may be pivotally rotated about the pressure member rotating portion 138.

A pressure member rotating axis 138*a* of the pressure member rotating portion 138 may be spaced apart from the shaft 122 that is a rotation center axis of the link member 124 and the pickup roller 112. As rotation centers of the pressure member 132 and the link member 124 are spaced apart from each other, a position of a pressure applied portion 126 of the link member 124 corresponding to the pressure applying portion 134 of the pressure member 132 may vary while the pickup holder 114 is rotated based on the quantity of the printing media S. The pressure member rotating axis 138*a* may be referred to as a third axis a3 corresponding to the first axis a1.

The pressure applying portion 134 may be formed at the other end of the pressure member body 136 to apply pressure to the link member 124. The link member 124 includes the pressure applied portion 126 corresponding to the pressure applying portion 134. A position of the pressure applied portion 126 on the link member 124 may vary as a rotation angle of the pickup holder 114 varies based on the quantity of the printing media S. That is, the pressure applying portion 134 may apply pressure to a variable point of the link member 124.

More specifically, the pressure applied portion 126 is located within a pressure applied section 128 as exemplarily shown in FIGS. 5 and 8. The pressure applied section 128 is defined on the link member 124 between a first point 128*a* as exemplarily shown in FIG. 5 and a second point 128*b* as exemplarily shown in FIG. 8. Here, the first point 128*a* corresponds to the pressure applying portion 134 when the pickup roller 112 is spaced apart from the supply tray 160 under the condition of a maximum quantity of the printing media S, and the second point 128*b* corresponds to the pressure applying portion 134 when the pickup roller 112 comes into close contact with the supply tray 160 under the condition of a minimum quantity of the printing media S, i.e. under provision of one sheet of the printing medium S.

In other words, when a maximum quantity of the printing media S is loaded, the pickup roller 112 is moved upward, causing the pressure applying portion 134 of the pressure member 132 to come into contact with the first point 128*a* on the link member 124. When a minimum quantity of the printing media S is loaded, the pickup roller 112 is moved downward, causing the pressure applying portion 134 of the pressure member 132 to come into contact with the second point 128*b* on the link member 124, the second point 128*b* being spaced farther away from the shaft 122 than the first point 128*a*. The first point 128*a* and the second point 128*b* define both ends of the pressure applied section 128, and the pressure applied portion 126 is located within the pressure applied section 128.

The pressure member 132 further includes the elastic hook 139.

The elastic hook 139 is formed on the pressure member body 136 to fix one end of the elastic member 140. Although the elastic hook 139 is formed on a face of the pressure member body 136 corresponding to the link member 124 in an embodiment, a position of the elastic hook 139 is not limited thereto.

The elastic member 140 generates elastic force for pickup pressure of the pickup roller 112, and is elastically supported by the pressure member 132 to transmit elastic force to the link member 124.

More specifically, one end of the elastic member 140 is fixed to the elastic hook 139 and the other end of the elastic member 140 is fixed to an elastic fixing portion 103 formed on the upper case 101*a*. Pivotal rotation of the pressure member 132 is adjusted by tension of the elastic member 140.

The elastic fixing portion 103 is formed at the fixed upper case 101*a* and thus has no position variation, whereas the elastic hook 139 is pivotally rotatable by the pressure member 132. Thus, the elastic force F of the elastic member 140 varies based on the loading capacity of the printing media S.

In other words, the pickup roller 112 is located at a lower position under a minimum quantity of the printing media S than a position thereof under a maximum quantity of the printing media S, thus causing the link member 124 and the pressure member 132 to be moved forward thereby. This may reduce a distance between the elastic hook 139 and the elastic fixing portion 103, resulting in variation of elastic force F.

The upper printing medium supply device 100 may further include the locking unit 150.

The locking unit 150 moves the pickup roller 112 from the printing medium S to limit pickup operation.

The locking unit 150 includes a locking protrusion 152 and a solenoid 156.

The locking protrusion 152 is rotatable and is provided at one side thereof with a pusher 154 to push the link member 124 rearward, so as to rotate the pickup holder 114 and move the pickup roller 112 upward.

The locking protrusion 152 is moved by the solenoid 156 and an elastic locking member 157. More specifically, the locking protrusion 152 is provided with a rotation regulator 153, and the solenoid 156 is located at one side of the rotation regulator 153 and the elastic locking member 157 is located at the other side of the rotation regulator 153 to operate the locking protrusion 152.

That is, when the locking unit 150 restricts pickup operation, the solenoid 156 is not operated, and the locking protrusion 152 is rotated by the elastic locking member 157, causing the pusher 154 to push the link member 124 rearward. Through this operation, the pickup roller 112 is spaced apart from the printing medium S and pickup operation of the pickup roller 112 is limited.

When the locking unit 150 releases restriction of pickup operation, the solenoid 156 rotates the locking protrusion 152 in an opposite direction with greater force than the elastic force of the elastic locking member 157 and the pusher 154 is separated from the link member 124. Through this operation, the pickup roller 112 comes into contact with the printing medium S and restriction of pickup operation of the pickup roller 112 is released.

The printing medium supply device 100 may further include an overlap prevention member 180 that prevents supply of overlapped sheets.

The overlap prevention member 180 serves to prevent a plurality of printing media S from being supplied into the image forming apparatus 1 at once, rather than being picked up one by one by the pickup roller 112.

The overlap prevention member 180 may have a roller form, and may be located below the feed roller 120 so as to come into close contact with the feed roller 120. The overlap prevention member 180 is coupled to a torque meter (not shown). The overlap preventing member 180 is rotated while being engaged with the feed roller 120 under the condition of a predetermined torque or more when the printing medium S passes through a gap between the feed roller 120 and the overlap prevention member 180, but stops under the condition of a torque less than the predetermined torque to prevent the plural printing media S from being supplied into the image forming apparatus 1.

That is, S when the printing medium S is supplied one by one by the pickup roller 112, friction between the feed roller 120 and the printing medium generates a predetermined torque to cause the overlap prevention member 180 to be engaged and rotated with the feed roller 120. However, when two or more sheets of the printing media S are supplied, friction between the printing media S is less than the friction between the feed roller 120 and the printing medium S, thus generating a lower torque. Under the condition of torque less than a predetermined value, the overlap prevention member 180 stops rotation, or is rotated at lower revolutions per minute than the feed roller 120, thus preventing supply of the printing media S close to the overlap prevention member 180.

Hereinafter, the printing medium supply device having the above described configuration and operation principle of the image forming apparatus will be described.

Assuming a distance between the shaft 122 and the pressure applied portion 126 of the link member 124 corresponding to the pressure applying portion 134 of the pressure member 132 is r and elastic force generated by the elastic member 140 is F, the moment M of the shaft 122 satisfies the following Equation:

$$M=F*r$$

(here, F is elastic force of the elastic member 140 and r is a distance between the shaft 122 and the pressure applied portion 126).

A first state refers to a state in which a maximum quantity of printing media S is loaded on the supply tray 160. In the first state, when the pickup roller 112 is moved upward such that the pressure applied portion 126 of the link member 124 corresponding to the pressure applying portion 134 reaches the first point 128*a*, the aforementioned r, F, M may be designated by r1, F1, M1 respectively.

A second state refers to a state in which a minimum quantity of printing media S is loaded on the supply tray 160. In the second state, when the pickup roller 112 is moved downward such that the pressure applied portion 126 of the link member 124 corresponding to the pressure applying portion 134 reaches the second point 128*b*, the aforementioned r, F, M may be designated by r2, F2, M2 respectively.

In this case, $r1<r2<r3$ is established. Hence, M1 and M2 satisfies M1 M2.

With the above described results, moment of the pickup holder 114 about the shaft 122 keeps a constant magnitude even if the quantity of the printing media S varies, and therefore the pickup roller 112 applies constant pickup pressure to the printing media S. This principle is applied to the first state and the second state, and is also applied even when the quantity of the printing media S is medium between the maximum quantity and the minimum quantity.

A printing medium supply device shown in FIG. 10 and an image forming apparatus having the same in accordance with an embodiment will be described.

The same components of an embodiment as the above described components will not be described hereinafter.

A pressure member 232 may include a pressure member body 236, a pressure applying portion 234, and an elastic hook 239.

The pressure member body 236 may implement sliding and the pressure applying portion 234 is provided at an end of the pressure member body 236 to apply pressure to the link member 124.

More specifically, the pressure member 232 further includes a sliding member 238 to reciprocally move the pressure member body 236 in a given direction. The pressure member body 236 may slide under assistance of the sliding member 238.

The pressure applying portion 234 is formed at the end of the pressure member body 236 to apply pressure to the pressure applied portion 126 of the link member 124.

The elastic hook 239 is formed on the pressure member body 236 to fix one end of the elastic member 140. Although the elastic hook 239 is formed at a face of the pressure member body 236 corresponding to the link member 124 in an embodiment, a position of the elastic hook 239 is not limited thereto.

As is apparent from the above description, a printing medium supply device and an image forming apparatus having the same may achieve enhanced pickup performance to prevent a plurality of printing media from being supplied into the image forming apparatus at once or no supply of printing media by varying pickup pressure based on the quantity of printing media.

Although embodiments have been shown and described, it would be appreciated by those skilled in the art that changes may be made in these embodiments without departing from the principles and spirit of the disclosure, the scope of which is defined in the claims and their equivalents.

What is claimed is:

1. A printing medium supply device comprising:

a pickup roller configured to come into contact with a printing medium;

a pickup holder configured to support the pickup roller, the pickup holder being rotated about a shaft to lift or lower the pickup roller;

a link member connected to the pickup holder so as to be rotated about the shaft;

a pressure member coming into contact with a pressure applied portion of the link member to rotate the link member by applying pressure to the link member; and an elastic member elastically supported by the pressure member to transmit elastic force to the link member, wherein the pickup holder includes:

a holder body configured to be pivotally rotated about the shaft;

a holder rotating portion which has a cylindrical shape and which is coupled to the shaft at one side of the holder body;

a holder support portion configured to support the pickup roller at the other side of the holder body; and wherein the link member protrudes from the holder rotating portion and has a cylindrical shape.

2. The device according to claim 1, further comprising a tray on which printing media is loaded, wherein the pickup roller has a variable vertical position depending on the quantity of printing media loaded on the tray, and wherein a distance from the center of the shaft to the pressure applied portion varies based on a position of the pickup roller.

3. The device according to claim 2, wherein:

the distance is r1 when the pickup roller is located at a first position, the distance is r2 when the pickup roller is located at a second position lower than the first position, and r2 is greater than r1.

4. The device according to claim 1, wherein the link member is pivotally rotated along with the pickup holder.

5. The device according to claim 1, wherein the pressure member includes:

a movable pressure member body;

an elastic hook formed at the movable pressure member body so that one end of the elastic member is fixed to the elastic hook; and a pressure applying portion formed at one end of the movable pressure member body to apply pressure to the link member.

6. The device according to claim 5, wherein the pressure member further includes a pressure member rotating portion formed at the other end of the movable pressure member body to enable pivotal rotation of the movable pressure member body.

7. The device according to claim 6, wherein the pressure member rotating portion is rotated about a pressure member rotating axis spaced apart from the shaft.

8. The device according to claim 1, wherein the pressure applied portion of the link member is moved to be spaced apart from the shaft as the pickup roller is lowered.

9. The device according to claim 1, further comprising a supply tray on which printing media is loaded, wherein:

the pressure applied portion is located within a pressure applied section defined between a first point on the link member and a second point on the link member, the first point on the link member coming into contact with the pressure applying portion of the pressure member when the pickup roller is spaced apart from the supply tray, the second point on the link member coming into contact with the pressure applying portion when the pickup roller comes into close contact with the supply tray, and the second point on the link member being farther spaced apart from the shaft than the first point on the link member.

10. The device according to claim 1, wherein moment of the pickup holder about the shaft, generated by a distance between the pressure applied portion and the shaft and elastic force of the elastic member, keeps a constant magnitude.

11. The device according to claim 1, further comprising:

a feed roller configured to be rotated by the shaft to supply the printing medium picked up by the pickup roller;

a plurality of gears to transmit rotation of the shaft to the pickup roller; and one-way clutches arranged respectively at a junction between the shaft and the feed roller and the pickup roller and a junction between the pickup roller and the gears.

12. The device according to claim 1, further comprising a supply tray on which printing media is loaded, wherein the supply tray is a manual supply tray for manual supply of the printing media.

13. A printing medium supply device comprising:

a pickup roller configured to come into contact with a printing medium;

a pickup holder configured to support the pickup roller, the pickup holder being rotated about a shaft to lift or lower the pickup roller;

a link member connected to the pickup holder so as to be rotated about the shaft;

a pressure member coming into contact with a pressure applied portion of the link member to rotate the link member by applying pressure to the link member; and an elastic member elastically supported by the pressure member to transmit elastic force to the link member, wherein one end of the elastic member is fixed to an elastic hook formed at the pressure member, and the other end of the elastic member is fixed to an elastic fixing portion formed at a printing medium supply device case defining an external appearance of the printing medium supply device, wherein the pickup holder includes:

a holder body configured to be pivotally rotated about the shaft;

a holder rotating portion which has a cylindrical shape and which is coupled to the shaft at one side of the holder body;

a holder support portion configured to support the pickup roller at the other side of the holder body; and wherein the link member protrudes from the holder rotating portion and has a cylindrical shape.

14. An image forming apparatus comprising:

an image forming apparatus main body; and a printing medium supply device to supply a printing medium into the image forming apparatus main body, wherein the printing medium supply device includes:

a printing medium supply device case;

a shaft rotated by a drive source and pivotally rotatably supported by the printing medium supply device case;

a pickup roller spaced apart from the shaft so as to come into contact with the printing medium;

a pickup holder configured to support the pickup roller, the pickup holder being rotated about the shaft to lift or lower the pickup roller;

a link member configured to be pivotally rotated along with the pickup holder;

a pressure member having a pressure applying portion formed at one end thereof to apply pressure to the link member; and an elastic member to generate elastic force for pickup pressure of the pickup roller to be applied to the printing medium, one end of the elastic member being fixed to the pressure member, wherein a distance between a pressure applied portion, located on the link member to correspond to the pressure applying portion of the pressure member, and a center of the shaft varies based on a position of the link member, wherein the pickup holder includes:

a holder body configured to be pivotally rotated about the shaft;

a holder rotating portion which has a cylindrical shape and which is coupled to the shaft at one side of the holder body;

a holder support portion configured to support the pickup roller at the other side of the holder body; and wherein the link member protrudes from the holder rotating portion and has a cylindrical shape.

15. The apparatus according to claim 14, wherein the printing medium supply device further includes a tray on which printing media is loaded, wherein the pickup roller has a variable vertical position depending on a quantity of printing media loaded on the tray, and wherein the distance from the center of the shaft to the pressure applied portion varies based on a position of the pickup roller.

16. The apparatus according to claim 15, wherein:

the distance is r1 when the pickup roller is located at a first position, the distance is r2 when the pickup roller is located at a second position lower than the first position, and r2 is greater than r1.

17. The apparatus according to claim 14, wherein:

the pickup roller has a variable vertical position depending on the quantity of printing media loaded on the tray, and elastic force of the elastic member varies based on a position of the pickup roller.

18. The apparatus according to claim 17, wherein:

the elastic force is F1 when the pickup roller is located at a first position, the elastic force is F2 when the pickup roller is located at a second position lower than the first position, and F2 is less than F1.

19. The apparatus according to claim 14, wherein the holder body and the link member are perpendicular to each other.

20. The apparatus according to claim 14, wherein the pickup holder and the link member are integrally formed with each other.

21. The apparatus according to claim 14, wherein the pressure member includes a pressure member rotating portion to enable pivotal rotation of the pressure applying portion of the pressure member, the pressure member rotating portion having a pressure member rotating axis spaced apart from the shaft.

22. The apparatus according to claim 14, wherein a position of the pressure applied portion on the link member is variable as the pickup roller is lifted or lowered.

23. The apparatus according to claim 14, wherein the other end of the elastic member is fixed to an elastic fixing portion formed at the printing medium supply device case so that a length of the elastic member is variable via movement of the pressure applying portion of the pressure member.

24. The apparatus according to claim 14, wherein the printing medium supply device further includes a manual supply tray for manual supply of printing media, in which the printing media is loaded and exposed to the outside, wherein the printing medium supply device is configured to supply the printing media loaded on the manual supply tray.

25. A printing medium supply device comprising:

a pickup roller spaced apart from a shaft and configured to come into contact with a printing medium;

a pickup holder configured to support the pickup roller, the pickup holder being pivotally rotated along with the shaft to lift or lower the pickup roller;

a link member provided at the pickup holder to adjust pressure to be applied to the pickup roller;

an elastic member to provide the pickup roller with pickup force for the printing medium; and a pressure member connected to one end of the elastic member to apply pressure to the link member, wherein the pickup holder includes:

a holder body configured to be pivotally rotated about the shaft;

a holder rotating portion which has a cylindrical shape and which is coupled to the shaft at one side of the holder body;

a holder support portion configured to support the pickup roller at the other side of the holder body; and wherein the link member protrudes from the holder rotating portion and has a cylindrical shape.

26. A printing medium supply device comprising:

a pickup holder, one side of which is rotatable about a first axis;

a pickup roller supported by the other side of the pickup holder so as to be vertically moved via rotation of the pickup holder, the pickup roller being rotatable about a second axis to come into contact with a printing medium and pick up the printing medium;

a pressure member to apply pressure to the pickup holder, the pressure member being rotatable about a third axis;

an elastic member to elastically bias the pressure member so that the pressure member rotates the pickup holder to push the pickup roller toward the printing medium; and a link member coupled to the pickup holder so as to be rotatable about the first axis, the link member transmitting pressure from the pressure member to the pickup holder, wherein the pickup holder includes:

a holder body configured to be pivotally rotated about the first axis;

a holder rotating portion which has a cylindrical shape and which is coupled to a shaft at one side of the holder body, the first axis passing through the shaft;

a holder support portion configured to support the pickup roller at the other side of the holder body; and wherein the link member protrudes from the holder rotating portion and has a cylindrical shape.

27. The device according to claim 26, wherein the pressure member applies pressure to a variable position of the pickup holder depending on a rotation position thereof.

28. The device according to claim 26, further comprising a tray on which printing media is loaded, wherein the pickup roller has a variable vertical position based on the quantity of printing media loaded on the tray, and wherein a distance from the first axis to a pressure applied portion of the link member, to which the pressure is applied by the pressure member, varies based on a position of the pickup roller.

29. The device according to claim 28, wherein:

the distance is r1 when the pickup roller is located at a first position, the distance is r2 when the pickup roller is located at a second position lower than the first position, and wherein r2 is greater than r1.

* * * * *